US011399615B2

(12) United States Patent
Shen

(10) Patent No.: US 11,399,615 B2
(45) Date of Patent: Aug. 2, 2022

(54) COSMETIC BOTTLE WITH SWITCH

(71) Applicant: APR Beauty Group Inc., Toronto (CA)

(72) Inventor: Jun Shen, New Westminster (CA)

(73) Assignee: APR Beauty Group Inc., Toronto (CA)

( * ) Notice: Subject to any disclaimer, the term of this patent is extended or adjusted under 35 U.S.C. 154(b) by 448 days.

(21) Appl. No.: 16/673,545

(22) Filed: Nov. 4, 2019

(65) Prior Publication Data

US 2020/0359767 A1 Nov. 19, 2020

(30) Foreign Application Priority Data

May 14, 2019 (CN) ..... 201920688548.8

(51) Int. Cl.
*A45D 34/04* (2006.01)
*A45D 40/26* (2006.01)

(52) U.S. Cl.
CPC ..... *A45D 34/04* (2013.01); *A45D 40/26* (2013.01)

(58) Field of Classification Search
CPC .. A45D 34/00; A45D 34/04; A45D 2200/054; A45D 40/26; A46B 11/00; A46B 11/001; A46B 11/0079; A46B 11/0072; A47L 13/26; A47L 13/42
USPC ..... 401/261–263, 265, 266, 269, 281
See application file for complete search history.

(56) References Cited

U.S. PATENT DOCUMENTS 4,930,922 A * 6/1990 LaRosa ..... A45D 34/043 401/277
7,963,713 B2 * 6/2011 Wang ..... A46B 11/0041 401/281

* cited by examiner

*Primary Examiner* — David J Walczak

(57) ABSTRACT

A cosmetic bottle with a switch comprises a bottle body, a bottle neck, a bottle mouth and a bottle cap, wherein the top end of the bottle neck is provided with a first limiting ring and a second limiting ring, an emulsion outlet is formed at the top end of the bottle neck between the first limiting ring and the second limiting ring, and a first outlet is formed on a sidewall of the first limiting ring; the bottle mouth is sheathed on an outer sidewall of the second limiting ring and is rotatably connected to the second limiting ring, and a first rotating ring and a second rotating ring are disposed in an inner cavity of the bottle mouth; the first rotating ring is sheathed on an outer sidewall of the first limiting ring, and a second outlet is formed on a sidewall of the first rotating ring; and the second limiting ring is sheathed on an outer sidewall of the second rotating ring

4 Claims, 6 Drawing Sheets

COSMETIC BOTTLE WITH SWITCH

TECHNICAL FIELD

The present invention relates to the technical field of cosmetic bottles, and in particular to a cosmetic bottle with a switch.

BACKGROUND ART

With the progress of the times and the increasing pursuit of quality of life, accordingly tools for such as massaging and makeup have gradually diversified, especially in the cosmetic industry. Cosmetics usually involve emulsion-like and viscous products, which are absorbed by repeated massaging with the skin, and at present, when the product in a cosmetic bottle is used, a bottle cap needs to be opened, then the product is poured into the palm and absorbed by repeated massaging with the skin, and it is inconvenient to open and close the bottle cap. Therefore, a cosmetic bottle enabling an outlet of same to be easily opened or closed is a topic worthy to study.

SUMMARY OF THE INVENTION

The present invention mainly solves the technical problem existing in the prior art described above, and provides a cosmetic bottle with a switch.

The above technical problem of the present invention is mainly solved by the following technical solution: a cosmetic bottle with a switch, which comprises a bottle body, a bottle neck, a bottle mouth and a bottle cap, wherein the bottle body and the bottle neck are integrated as a whole, the top end of the bottle neck is provided with a first limiting ring and a second limiting ring, an emulsion outlet is formed at the top end of the bottle neck between the first limiting ring and the second limiting ring, and a first outlet is formed on a sidewall of the first limiting ring; the bottle mouth is sheathed on an outer sidewall of the second limiting ring and is rotatably connected to the second limiting ring, and a first rotating ring and a second rotating ring are disposed in an inner cavity of the bottle mouth; the first rotating ring matches the first limiting ring, the first rotating ring is sheathed on an outer sidewall of the first limiting ring, and a second outlet is formed on a sidewall of the first rotating ring; the second rotating ring matches the second limiting ring, and the second limiting ring is sheathed on an outer sidewall of the second rotating ring; and the bottle mouth is rotated to control the first outlet and the second outlet such that same are communicated with each other or separated from each other, the bottle cap and the bottle mouth are connected by a snap connection, and the bottle cap and the bottle neck are connected by threads.

Preferably, an outer sidewall of the bottle mouth is provided with two clamping grooves which are disposed symmetric to each other, an outer sidewall of the bottle neck is provided with two external threads which are disposed symmetric to each other, and two ends of the external threads directly face the clamping grooves, respectively; and an inner sidewall of the bottle cap is provided with internal threads matching the external threads and clamping blocks matching the clamping grooves, the bottle cap and the bottle neck are connected by threaded connections between the external threads and the internal threads, and the bottle cap and the bottle mouth are connected by snap connections between the clamping blocks and the clamping grooves.

Preferably, an annular block is disposed at a junction of the second limiting ring and the bottle neck, a first limiting block is disposed on the outer sidewall of the second limiting ring, and the bottom end of the first limiting block is connected to the top end of the annular block; an inner sidewall of the bottle mouth is provided with a snap joint matching the annular block, the snap joint is snapped to the annular block, and a bottom wall of the annular block is slidably connected to a top wall of the snap joint; a second limiting block is further disposed on the inner sidewall of the bottle mouth; and the first limiting block, the first outlet, the second limiting block and the second outlet are disposed, in an annular array, in the inner cavity of the bottle mouth.

Preferably, a receiving cavity is disposed at the center of the bottle body, and a liquid discharge head is disposed at the top of the bottle mouth.

The present invention has the advantageous effects: the present invention drives the bottle mouth to rotate by means of rotation of the bottle cap, and utilizes the rotation of the bottle mouth to control the first outlet and the second outlet such that same are communicated with each other or separated from each other, thereby opening or closing the cosmetic bottle outlet; when the bottle cap is separated from the bottle body, the first outlet and the second outlet are communicated with each other, and a cosmetic emulsion can be directly discharged; and when the bottle cap and the bottle body are fastened, the first outlet and the second outlet are separated from each other to block the discharge of the cosmetic emulsion. Compared with the traditional cosmetic bottle of a pressing nozzle type and that of a valve type, the present invention has a simple structure, is convenient to assemble, and is also convenient and simple to use by a consumer.

In the figures: 1. Bottle body; 2. Bottle neck; 3. Bottle mouth; 4. Bottle cap; 5. First limiting ring; 6. Second limiting ring; 7. Emulsion outlet; 8. First outlet; 9. First rotating ring; 10. Second rotating ring; 11. Second outlet; 12. Clamping groove; 13. External thread; 14. Internal thread; 15. Clamping block; 16. Annular block; 17. First limiting block; 18. Snap joint; 19. Second limiting block; 20. Receiving cavity; 21. Liquid discharge head.

DETAILED DESCRIPTION OF EMBODIMENTS

The technical solution of the present invention will be further specifically illustrated below by way of an embodiment and in conjunction with the accompanying drawings.

Embodiment

Figure 1:
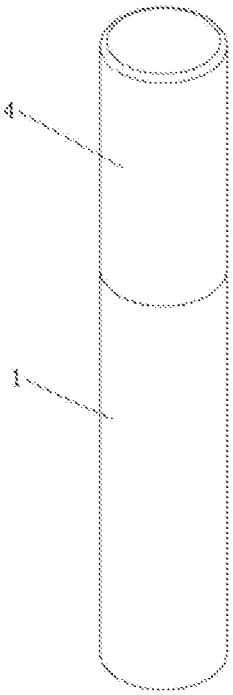
FIG. 1 is a structural schematic diagram of the present invention.
Figure 2:
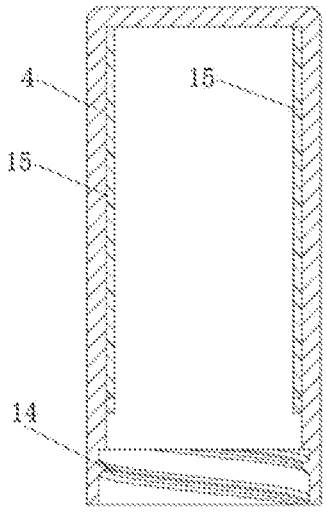
FIG. 2 is a cross-sectional structural schematic diagram of a bottle cap of the present invention.
Figure 3:
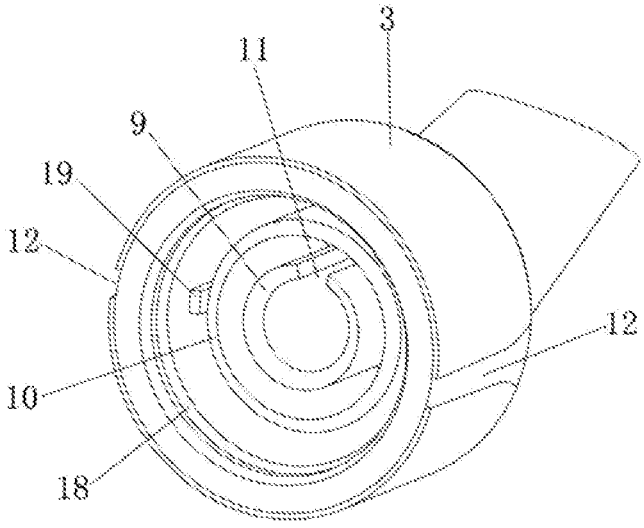
FIG. 3 is a structural schematic diagram of a nozzle of the present invention.
Figure 4:
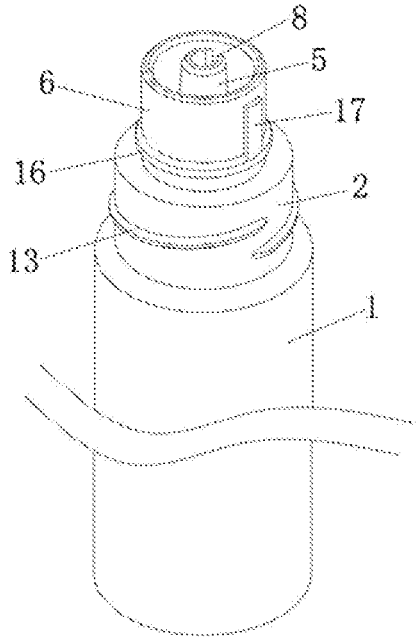
FIG. 4 is a combined structural schematic diagram of a bottle body and a bottle neck of the present invention.
Figure 5:
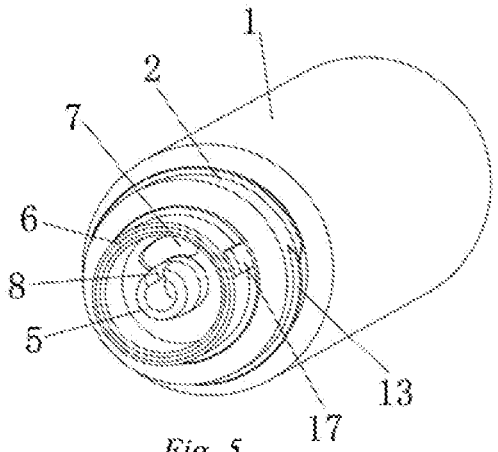
FIG. 5 is a combined structural schematic diagram of another perspective of the bottle body and the bottle neck of the present invention.
Figure 6:
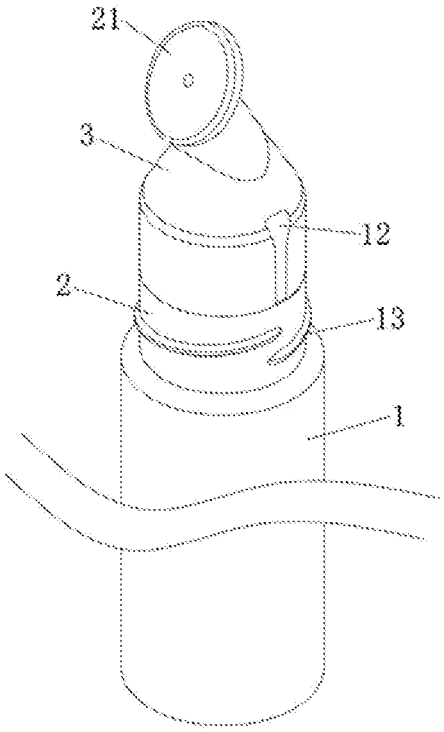
FIG. 6 is a combined structural schematic diagram of the bottle body, the bottle neck, a bottle mouth and a liquid discharge head of the present invention.
Figure 7:
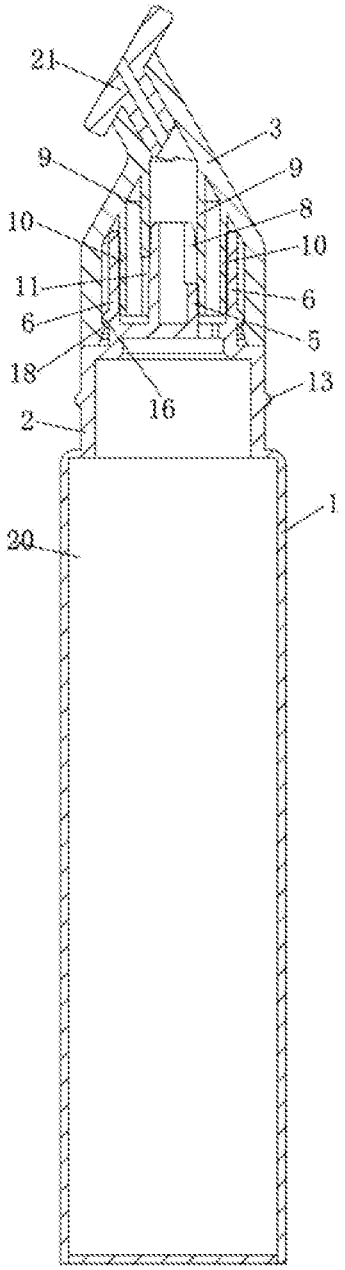
FIG. 7 is a cross-sectional structural schematic diagram of the bottle body, the bottle neck, the bottle mouth and the liquid discharge head of the present invention.
Figure 8:
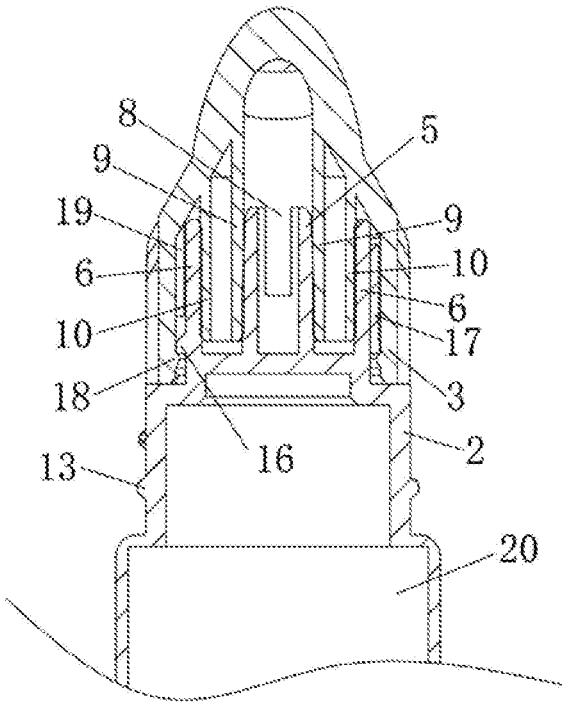
FIG. 8 is a cross-sectional structural schematic diagram of another perspective of the bottle body, the bottle neck, the bottle mouth and the liquid discharge head of the present invention.

A cosmetic bottle with a switch, as shown in FIGS. 1 to 8, comprises a bottle body 1, a bottle neck 2, a bottle mouth 3 and a bottle cap 4, wherein the bottle body 1 and the bottle neck 2 are integrated as a whole, and the bottle body 1 is of soft plastic; the top end of the bottle neck 2 is provided with a first limiting ring 5 and a second limiting ring 6, an emulsion outlet 7 is formed at the top end of the bottle neck 2 between the first limiting ring 5 and the second limiting ring 6, and a first outlet 8 is formed on a sidewall of the first limiting ring 5; the bottle mouth 3 is sheathed on an outer sidewall of the second limiting ring 6 and is rotatably connected to the second limiting ring 6, and a first rotating ring 9 and a second rotating ring 10 are disposed in an inner cavity of the bottle mouth 3; the first rotating ring 9 matches the first limiting ring 5, the first rotating ring 9 is sheathed on an outer sidewall of the first limiting ring 5, and a second outlet 11 is formed on a sidewall of the first rotating ring 9; the second outlet 11 directly faces the first outlet 8, the second rotating ring 10 matches the second limiting ring 6, and the second limiting ring 6 is sheathed on an outer sidewall of the second rotating ring 10; and the bottle mouth 3 is rotated to control the first outlet 8 and the second outlet 11 such that same are communicated with each other or separated from each other, the bottle cap 4 and the bottle mouth 3 are connected by a snap connection, and the bottle cap 4 and the bottle neck 2 are connected by threads.

An outer sidewall of the bottle mouth 3 is provided with two clamping grooves 12, the two clamping grooves 12 are disposed symmetric to each other, an outer sidewall of the bottle neck 2 is provided with two external threads 13, the two external threads 13 are disposed symmetric to each other, and two ends of the external threads 13 directly face the clamping grooves 12, respectively; and an inner sidewall of the bottle cap 4 is provided with internal threads 14 matching the external threads 13 and clamping blocks 15 matching the clamping grooves 12, two clamping blocks 15 are provided, the two clamping blocks 15 are disposed symmetric to each other, the bottle cap 4 and the bottle neck 2 are connected by threaded connections between the external threads 13 and the internal threads 14, and the bottle cap 4 and the bottle mouth 3 are connected by snap connections between the clamping blocks 15 and the clamping grooves 12.

An annular block 16 is disposed at a junction of the second limiting ring 6 and the bottle neck 2, a first limiting block 17 is disposed on the outer sidewall of the second limiting ring 6, and the bottom end of the first limiting block 17 is connected to the top end of the annular block 16; an inner sidewall of the bottle mouth 3 is provided with a snap joint 18 matching the annular block 16, the snap joint 18 is snapped to the annular block 16, and a bottom wall of the annular block 16 is slidably connected to a top wall of the snap joint 18; a second limiting block 19 is further disposed on the inner sidewall of the bottle mouth 3, the second limiting block 19 directly faces the first limiting block 17; the first limiting block 17, the first outlet 8, the second limiting block 19 and the second outlet 11 are disposed, in an annular array, in the inner cavity of the bottle mouth 3; and the first limiting block 17 directly faces one of the clamping grooves 12, and the second limiting block 19 directly faces the other of the clamping grooves 12.

A receiving cavity 20 is disposed at the center of the bottle body 1, the receiving cavity 20 is used for filling with an emulsion, a liquid discharge head 21 is disposed at the top of the bottle mouth 3, and the liquid discharge head 21 is used for coming into contact with the skin and repeatedly massaging the skin.

When in use, the bottle cap is unscrewed, the bottle cap drives the bottle mouth to rotate together, and the rotation of the bottle mouth drives the first rotating ring to rotate on the outer sidewall of the first limiting ring; the rotation of the first rotating ring turns the second outlet to the first outlet, and the rotation of the bottle mouth turns the second limiting block to the first limiting block; when the internal threads on the bottle cap are separated from the external threads on the bottle neck, the first limiting block and the second limiting block are in contact with each other and prevent the bottle mouth from continuing to rotate; the first outlet and the second outlet are communicated, then the bottle body is gripped, and the bottle cap is pulled outward such that the clamping blocks are disengaged from the clamping grooves; that is, the bottle cap is opened, by means of squeezing the bottle body, the emulsion in the bottle body flows to the liquid discharge head through the emulsion outlet, the second outlet, the first outlet, the inner cavity of the first limiting ring and the inner cavity of the first rotating ring. After use, the bottle cap is covered such that the clamping blocks are snapped to the clamping grooves, then the bottle cap is screwed in reverse, and the bottle cap drives the bottle mouth to rotate together; and when the bottle cap is tightened on the bottle body, the first outlet and the second outlet are separated from each other, thus blocking the discharge of cosmetics.

In summary, the present invention drives the bottle mouth to rotate by means of rotation of the bottle cap, and utilizes the rotation of the bottle mouth to control the first outlet and the second outlet such that same are communicated with each other or separated from each other, thereby opening or closing the cosmetic bottle outlet; when the bottle cap is separated from the bottle body, the first outlet and the second outlet are communicated with each other, and a cosmetic emulsion can be directly discharged; and when the bottle cap and the bottle body are fastened, the first outlet and the second outlet are separated from each other to block the discharge of the cosmetic emulsion. Compared with the traditional cosmetic bottle of a pressing nozzle type and that of a valve type, the present invention has a simple structure, is convenient to assemble, and is also convenient and simple to use by a consumer.

Finally, it should be noted that the above embodiment is merely a representative example of the present invention. Obviously, the present invention is not limited to the above embodiment, and many variations are possible. Any simple amendments, equivalent variations and modifications made to the above embodiment in accordance with the technical essence of the present invention are considered to be within the scope of protection of the present invention.

The invention claimed is:

1. A cosmetic bottle with a switch, which comprises a bottle body, a bottle neck, a bottle mouth and a bottle cap, wherein the bottle body and the bottle neck are integrated as a whole, a top end of the bottle neck is provided with a first limiting ring and a second limiting ring, an emulsion outlet is formed at the top end of the bottle neck between the first limiting ring and the second limiting ring, and a first outlet is formed on a sidewall of the first limiting ring; the bottle mouth is sheathed on an outer sidewall of the second limiting ring and is rotatably connected to the second limiting ring, and a first rotating ring and a second rotating ring are disposed in an inner cavity of the bottle mouth; the first rotating ring matches the first limiting ring, the first rotating ring is sheathed on an outer sidewall of the first limiting ring, and a second outlet is formed on a sidewall of the first rotating ring; the second rotating ring matches the second limiting ring, and the second limiting ring is sheathed on an outer sidewall of the second rotating ring; and the bottle mouth is rotated to control the first outlet and the second outlet such that same are communicated with each other or separated from each other, the bottle cap and the bottle mouth are connected by a snap connection, and the bottle cap and the bottle neck are connected by threads.

2. The cosmetic bottle with a switch according to claim 1, wherein an outer sidewall of the bottle mouth is provided with two clamping grooves which are disposed symmetric to each other, an outer sidewall of the bottle neck is provided with two external threads which are disposed symmetric to each other, and two ends of the external threads directly face the clamping grooves, respectively; and an inner sidewall of the bottle cap is provided with internal threads matching the external threads and clamping blocks matching the clamping grooves, the bottle cap and the bottle neck are connected by threaded connections between the external threads and the internal threads, and the bottle cap and the bottle mouth are connected by snap connections between the clamping blocks and the clamping grooves.

3. The cosmetic bottle with a switch according to claim 1, wherein an annular block is disposed at a junction of the second limiting ring and the bottle neck, a first limiting block is disposed on the outer sidewall of the second limiting ring, and a bottom end of the first limiting block is connected to a top end of the annular block; an inner sidewall of the bottle mouth is provided with a snap joint matching the annular block, the snap joint is snapped to the annular block, and a bottom wall of the annular block is slidably connected to a top wall of the snap joint; a second limiting block is further disposed on the inner sidewall of the bottle mouth; and the first limiting block, the first outlet, the second limiting block and the second outlet are disposed, in an annular array, in the inner cavity of the bottle mouth.

4. The cosmetic bottle with a switch according to claim 1, wherein a receiving cavity is disposed at a center of the bottle body, and a liquid discharge head is disposed at a top of the bottle mouth.

* * * * *